United States Patent [19]

Koehler

[11] 4,221,845

[45] Sep. 9, 1980

[54] PROCESS FOR PRETREATMENT OF LIGHT METALS BEFORE GALVANIZATION

[75] Inventor: Wolfgang Koehler, Alzenau, Fed. Rep. of Germany

[73] Assignee: Deutsche Gold- und Silber Scheideanstalt Vormals Roessler, Frankfurt, Fed. Rep. of Germany

[21] Appl. No.: 12,135

[22] Filed: Feb. 14, 1979

[30] Foreign Application Priority Data

Apr. 3, 1978 [DE] Fed. Rep. of Germany ..... 2809444

[51] Int. Cl.[3] ..... C23C 15/00; C25D 5/42

[52] U.S. Cl. ..... 428/670; 204/192 C; 204/192 R; 427/250; 427/305; 428/652; 428/654

[58] Field of Search ..... 428/670, 654, 652; 204/192 C, 192 R, 29, 33, 43 R; 427/250, 305

[56] References Cited

U.S. PATENT DOCUMENTS

| | | | |
|---|---|---|---|
| 2,915,406 | 12/1959 | Rhoda et al. | 106/1 |
| 3,428,490 | 2/1969 | Bravo et al. | 136/86 |
| 3,473,216 | 10/1969 | Webb et al. | 29/492 |
| 3,542,583 | 11/1970 | Small | 117/50 |
| 3,677,789 | 7/1972 | Bungardt et al. | 117/22 |
| 3,819,338 | 6/1974 | Bungardt et al. | 29/194 |
| 3,891,400 | 6/1975 | Robinson | 29/197.5 |
| 3,985,515 | 10/1976 | Greeson et al. | 29/195 |
| 3,986,944 | 10/1976 | Gould | 204/192 |
| 4,089,991 | 5/1978 | Robillard | 427/75 |

*Primary Examiner*—L. Dewayne Rutledge
*Assistant Examiner*—Upendra Roy
*Attorney, Agent, or Firm*—Cushman, Darby & Cushman

[57] ABSTRACT

Light metal surfaces, particularly of aluminium, magnesium, titanium, beryllium and their alloys are pretreated before galvanization electroplating in aqueous solution by applying a layer of a palladium alloy with cobalt and/or iron and/or nickel.

51 Claims, No Drawings

PROCESS FOR PRETREATMENT OF LIGHT METALS BEFORE GALVANIZATION

BACKGROUND OF THE INVENTION

The invention is directed to a process for the pretreatment of light metal surfaces which are commonly coated with an oxide layer, especially aluminium, titanium, magnesium, beryllium and their alloys for the galvanic deposition of metallic coatings.

Light metals and light metal alloys without a pretreatment are practically impossible to galvanize since the oxide film which is always present on the light metal surface prevents the adhesion of the metallic coating is applied to the surface. Even if the oxide film is removed and the clean metal surface is free it immediately forms the oxide film again in the air or aqueous solutions. Therefore there have been numerous attempts to permanently remove this oxide layer or to increase it in order to anchor the metal coating in the pores of the oxide layer. The processes developed for permanent removal of the oxide layer in the practice are just as little completely satisfactory as the anchoring processes in the synthetically thickened oxide layer.

Therefore it was the problem of the present invention to develop the most universal process possible for pretreatment of oxide layer coated light metals before the galvanization (electroplating) in aqueous solution, which should be usable with all light metals especially for aluminum, magnesium, titanium, beryllium and their alloys, wherein the later electroplated layer must adhere well to the base.

SUMMARY OF THE INVENTION

This problem is solved according to the invention by applying to the surfaces of the light metal which is to be electroplated a layer of palladium alloy with nickel and/or cobalt and/or iron. There have been found particularly effective palladium alloys with 20–70 weight % nickel or cobalt or iron which are preferably in a layer thickness of 0.02–15 microns, more usually 0.05–15 microns.

Unexpectedly these coatings have a very good adhesion to light metals, particularly if they are applied by vapor deposition in a vacuum or even better if they are applied by a sputter process. In a number of cases an even better adhesion to the light metal is produced if the surface is purified by a preceding ionic bombardment (glow discharge) before application of the alloy coating.

With certain zinc or cadmium containing alloys, e.g. AlMg3Zn, this pretreatment cannot be used because the zinc diffuses at the surface with the heat developed through the ionic bombardment or even partially volatilizes. Thereupon the palladium alloy coating for example a palladium nickel alloy then does not adhere sufficiently. To improve the adhesion there has been found suitable an intermediate layer of titanium having a thickness of about 0.1 micron thickness which is sputtered on before the PdNi or PdCo or PdFe. There are also suitable as metals for the intermediate layer aluminium, chromium, magnesium and manganese, which intermediate layers can also be used to improve adhesion with non-zinc containing light metal alloys.

The intermediate layer thickness can range from 0.01 to 5.0 microns.

An additional advantage of the palladium-nickel or palladium cobalt or palladium iron superimposed layer of the invention is the high mar resistance which is considerably better than that of the individual components. Aluminum or titanium sheets which are provided with an about 1.5 micron thick coating of Pd 50 Ni can be further handled or stored without special precautions.

The products can comprise, consist essentially of or consist of the materials set forth and the process can comprise, consist essentially of or consist of the steps set forth.

The following examples further explain the invention.

DESCRIPTION OF THE PREFERRED EMBODIMENTS

EXAMPLE 1

In a sputter apparatus of customary construction defatted sheets of AlMg3Zn were provided at an operating pressure of $1\times10^{-2}$ Torr in an argon atmosphere first under a titanium target with a Ti coating of about 0.1 micron thickness, then under a Pd 50 Ni target with a Pd-Ni coating that was about 1.5 micron thick.

These sheets were cathodically defatted in an aqueous bath and subsequently provided galvanically with 2.0 to 10 micron thick gold superimposed layers. The coating stays trouble free and withstands the Scotch-tape test. In a bending test around 180° C. even the 10 micron thick coating did not scale off.

EXAMPLE 2

In a sputter deposition apparatus some sheets of titanium were sputter-cleaned by an ion-bombardment at a pressure of $1\cdot10^{-2}$ Torr in an argon atmosphere. Then they are coated with a layer of Pd 50% Co under a target of a palladium 50% cobalt alloy at the same pressure. The layer has a thickness of about 2 microns.

These sheets are defatted in a customary aqueous bath (cathodic, 30 seconds, 10 Amp/dm$^2$). After a rinsing in water, they are galvanized in a weakly acid gold bath (pH 3.8) on the basis of $KAu_2CN_2$ with a weak organic acid (temperature 25° C.; 1 Amp/dm$^2$; 15 minutes for a layer of 2 microns thickness).

This coating adheres well, does not scale off and is trouble-free.

EXAMPLE 3

In a common sputter apparatus some foils of aluminium were sputter-cleaned as described in example (2). Then they are first coated at $1\cdot10^{-3}$ Torr in an argon atmosphere under a chromium target with a Cr coating of about 0.5 micron thickness, then under a Pd 50% Fe target with a PdFe coating at the same pressure. The layer has a thickness of about 1 micron. After this, the galvanic treatment is the same as in example (2).

What is claimed is:

1. A light metal having a surface suitable for galvanization in aqueous solution and having on said surface to improve the adherence to metal overcoats a coating of palladium alloy containing 20 to 70 weight % of a member of the group consisting of nickel, cobalt, iron and mixtures thereof.

2. A light metal alloy according to claim 1 wherein the coating is with a palladium nickel alloy.

3. A light metal alloy according to claim 1 wherein the coating is with a palladium-cobalt alloy.

4. A light metal alloy according to claim 1 wherein the coating is with a palladium-iron alloy.

5. A light metal surface according to claim 1 wherein the metal is aluminium, magnesium, titanium or beryllium or an alloy thereof.

6. A light metal surface according to claim 5 wherein the coating is with a palladium-nickel alloy.

7. A light metal surface according to claim 5 wherein the coating is with a palladium-cobalt alloy.

8. A light metal surface according to claim 5 wherein the coating is with a palladium-iron alloy.

9. A light metal surface according to claim 1 wherein the palladium alloy contains 50 weight % nickel and 50 weight % palladium.

10. A light metal surface according to claim 1 wherein the palladium alloy contains 50 weight % cobalt and 50 weight % palladium.

11. A light metal surface according to claim 1 wherein the palladium alloy contains 50 weight % iron and 50 weight % palladium.

12. A light metal surface according to claim 1 having between the light metal and the palladium alloy coating an intermediate layer thinner than said coating and being made of sputtered on aluminum, chromium, titanium, magnesium or manganese.

13. A light metal surface according to claim 12 wherein the coating is with a palladium-nickel alloy.

14. A light metal surface according to claim 12 wherein the coating is with a palladium-cobalt alloy.

15. A light metal surface according to claim 12 wherein the coating is with a palladium-iron alloy.

16. A light metal surface according to claim 12 wherein the adhesive intermediate layer has a thickness of about 0.1 micron and the palladium alloy has a thickness of about 1.5 microns.

17. A light metal surface according to claim 16 wherein the coating is with a palladium-nickel alloy.

18. A light metal surface according to claim 16 wherein the coating is with a palladium-cobalt alloy.

19. A light metal surface according to claim 16 wherein the coating is with a palladium-iron alloy.

20. A process for preparing the product of claim 1 comprising applying to the light metal surface a coating of a palladium alloy containing 20 to 70 weight % of a member of the group consisting of nickel, cobalt, iron and mixtures thereof.

21. A process according to claim 20 wherein the alloy is a palladium-nickel alloy.

22. A process according to claim 20 wherein the alloy is a palladium-cobalt or palladium-iron alloy.

23. A process according to claim 20 wherein the light metal is aluminium, magnesium, titanium or beryllium or an alloy of such light metal.

24. A process according to claim 23 wherein the alloy is a palladium-nickel alloy.

25. A process according to claim 23 wherein the alloy is a palladium-cobalt or palladium-iron alloy.

26. A process according to claim 20 comprising applying the palladium alloy by evaporation in a vacuum or by sputtering.

27. A process according to claim 26 wherein the alloy is a palladium-nickel alloy.

28. A process according to claim 26 wherein the alloy is a palladium-cobalt or palladium-iron alloy.

29. A process according to claim 26 comprising cleaning the light metal surface by ionic bombardment prior to applying the palladium alloy.

30. A process according to claim 29 wherein the alloy is a palladium-nickel alloy.

31. A process according to claim 30 wherein the alloy is a palladium-cobalt or palladium-iron alloy.

32. A process according to claim 30 comprising sputtering a thin adhesive layer of aluminium, chromium, titanium, magnesium or manganese on the light metal surface before applying the palladium alloy.

33. A process according to claim 32 wherein the alloy is a palladium-nickel alloy.

34. A process according to claim 32 wherein the alloy is a palladium-cobalt or palladium-iron alloy.

35. A process according to claim 20 wherein comprising sputtering a thin adhesive layer of aluminium, chromium, titanium, magnesium or manganese on the light metal surface before applying the palladium alloy.

36. A process according to claim 35 wherein the alloy is a palladium-nickel alloy.

37. A process according to claim 35 wherein the alloy is a palladium-cobalt or palladium-iron alloy.

38. A light metal surface according to claim 1 wherein the palladium alloy has a thickness of about 1.5 microns.

39. A light metal surface according to claim 38 wherein the coating is with a palladium-nickel alloy.

40. A light metal surface according to claim 38 wherein the coating is with a palladium-cobalt alloy.

41. A light metal surface according to claim 38 wherein the coating is with a palladium-iron alloy.

42. A process of galvanically depositing a metal coating on a light metal surface comprising galvanically depositing the metal coating on the palladium alloy coated surface of claim 38.

43. A process according to claim 42 wherein the alloy is a palladium-nickel alloy.

44. A process according to claim 42 wherein the alloy is a palladium-cobalt or palladium-iron alloy.

45. A process of galvanically depositing a metal coating on a light metal surface comprising galvanically depositing the metal coating on the palladium alloy coated surface of claim 1.

46. A process according to claim 45 wherein the alloy is a palladium-nickel alloy.

47. A process according to claim 45 wherein the alloy is a palladium-cobalt or palladium-iron alloy.

48. A light metal alloy according to claim 1 wherein the palladium alloy has a thickness of 0.02–15 microns.

49. A light metal alloy according to claim 1 wherein the palladium alloy has a thickness of 0.05–15 microns.

50. A light metal surface according to claim 1 wherein the palladium alloy coating and a thickness of 0.02–15 microns and between the light metal and the palladium alloy coating there is an intermediate layer having a thickness of 0.01–5.0 microns and which intermediate layer is also thinner than said palladium alloy coating, said intermediate layer being made of sputtered on aluminum, chromium, titanium, magnesium or manganese.

51. The process of claim 45 wherein the metal galvanically deposited is gold.

* * * * *